US009312592B2

(12) United States Patent
Noe

(10) Patent No.: US 9,312,592 B2
(45) Date of Patent: Apr. 12, 2016

(54) ADJUSTABLE DIRECTIONAL COUPLER CIRCUIT

(71) Applicant: Keysight Technologies, Inc., Minneapolis, MN (US)

(72) Inventor: Terrence R. Noe, Sebastopol, CA (US)

(73) Assignee: Keysight Technologies, Inc., Santa Rosa, CA (US)

( * ) Notice: Subject to any disclaimer, the term of this patent is extended or adjusted under 35 U.S.C. 154(b) by 212 days.

(21) Appl. No.: 13/832,494

(22) Filed: Mar. 15, 2013

(65) Prior Publication Data

US 2014/0266499 A1 Sep. 18, 2014

(51) Int. Cl.
*H01P 5/18* (2006.01)
*H01P 5/04* (2006.01)

(52) U.S. Cl.
CPC .. *H01P 5/18* (2013.01); *H01P 5/04* (2013.01); *H01P 5/184* (2013.01)

(58) Field of Classification Search
CPC ..... H01P 5/04; H01P 5/18; H01P 5/184; H03H 7/40
USPC ..... 333/17.1, 109, 111
See application file for complete search history.

(56) References Cited

U.S. PATENT DOCUMENTS

| | | | | |
|---|---|---|---|---|
| 4,467,293 | A * | 8/1984 | Apel | 333/112 |
| 4,493,112 | A * | 1/1985 | Bruene | 455/123 |
| 4,644,260 | A | 2/1987 | Warder | |

FOREIGN PATENT DOCUMENTS

| | | | |
|---|---|---|---|
| CA | 2053897 | A1 | 12/1990 |
| DE | 69230756 | T2 | 7/2000 |
| DE | 10121535 | A1 | 11/2002 |
| DE | 202007010239 | U1 | 9/2007 |
| DE | 102008005204 | A1 | 7/2009 |
| DE | 202008017972 | U1 | 1/2011 |
| EP | 2360776 | A1 | 8/2011 |
| GB | 2343790 | A | 5/2000 |
| JP | 1274502 | A | 11/1989 |

OTHER PUBLICATIONS

Search Report mailed Aug. 12, 2015 in German Patent Application No. DE102014101705.6 (Unofficial/non-certified translation provided by foreign agent included).
Machine translation of DE10121535 published Nov. 7, 2002.
Machine translation of DE102008005204 published Jul. 23, 2009.
Machine translation of DE202007010239 published Sep. 20, 2007.
Machine translation of DE69230756 published Jul. 20, 2000.

* cited by examiner

*Primary Examiner* — Benny Lee
*Assistant Examiner* — Albens Dieujuste

(57) ABSTRACT

An adjustable directional coupler circuit includes a directional coupler and a correction circuit. The directional coupler includes a first port for receiving an input signal; a second port for outputting the input signal to a load; a third port for outputting a first coupled signal including a desired first coupled signal proportional to forward power of the input signal and an extraneous first coupled signal proportional to reverse power of a reflected signal; and a fourth port for outputting a second coupled signal including a desired second coupled signal proportional to the reverse power and an extraneous second coupled signal proportional to the forward power. The correction circuit adjusts magnitude and phase of a sample of the second coupled signal to provide an adjusted second coupled signal, and to sum the adjusted second coupled signal and the first coupled signal to cancel the extraneous first coupled signal.

18 Claims, 6 Drawing Sheets

ADJUSTABLE DIRECTIONAL COUPLER CIRCUIT

BACKGROUND

A directional coupler is a four-port device that enables measurement of power of an input signal. The four ports may be labeled input port, output port, forward coupled port and the reverse coupled port. The input and output ports connect to a device under test (DUT), for example, and the forward and reverse coupled ports are used for monitoring power. The signal at the forward coupled port is proportional to the signal traveling in a forward direction, from the input port to the output port (e.g., input signal). The signal at the reverse coupled port is proportional to the signal traveling in a reverse direction, from the output port to the input port (e.g., reflected signal).

One common application of a directional coupler is monitoring power between a radio transmitter and an antenna in a radio system, for example, where the transmitter and the antenna are connected to the input port and the output port of the directional coupler, respectively. Power flows from the transmitter to the antenna (forward power), and thus from the input port to the output port. When the antenna is imperfect, some of the power reflects off the antenna (reverse power) and flows back toward the input port, returning to the radio transmitter. This is undesirable for at least two reasons. First, the reverse power reduces the amount of power radiated from the antenna, thus reducing range and sensitivity of the radio system. Second, an excessive amount of the reverse power may damage the transmitter. Therefore, antenna designs attempt to minimize reverse power.

FIG. 1 is a simplified block diagram of a directional coupler. Referring to FIG. 1, directional coupler 110 includes transmission line 111 having a first port 101 (input port) for receiving an input signal, e.g., from a radio transmitter, and a second port 102 (output port) for outputting the input signal, e.g. to an antenna. The directional coupler 110 also includes coupled line 112 having a third port 103 (forward coupled port) for presenting sampled power of the input signal flowing from the first port 101 to the second port 102, and a fourth port 104 (reverse coupled port) for presenting sampled power of a reflected signal (reflected from a load connected to the second port 102) flowing from the second port 102 to the first port 101. The fourth port 104 may also be referred to as an isolated port with regard to the input signal, and the third port 103 may be referred to as an isolated port with regard to the reflected signal. As mentioned above, the directional coupler 110 has the property that the power of the coupled signal measured at the third port 103 is proportional to the forward power, flowing from the first port 101 to the second port 102. Similarly, the power of the coupled signal measured at the fourth 104 is proportional to the reverse power, flowing from second port 102 to the first port 101. Thus, by measuring the power of the coupled signals at the third and fourth ports 103 and 104, the forward power and reverse power flowing between the transmitter and the antenna may be determined, respectively.

Power traveling between any two ports of the directional coupler 110 may be indicated using S-parameters, as is know in the art, where the first port 101 is port "1," the second port 102 is port "2," the third port 103 is port "3" and the fourth port 104 is port "4." Thus, the ratio between the power at the third port 103 and the forward power of the input signal, which may be referred to as the "coupling factor," may be indicated by $S_{31}$ in S-parameter terminology. In addition, $S_{31}$ is a measure of the sensitivity at the third port 103 to the forward power, and $S_{32}$ is a measure of the sensitivity at the third port 103 to the reverse power. The ratio between S-parameters $S_{32}$ and $S_{31}$ may be referred to as "directivity." Accordingly, the S-parameters of the directional coupler 110 with respect to coupling factor and directivity may be indicated as follows:

$$S_{31}=C$$

$$S_{32}=C*D$$

$$S_{42}=C$$

$$S_{41}=C*D$$

$$S_{12}=S_{21}\approx 1$$

In an ideal directional coupler, the third port 103 outputs only a coupled signal that is proportional to the forward power, and is not affected at all by the reverse power. Likewise, the fourth port 104 ideally outputs only a coupled signal that is proportional to the reverse power, and is not affected at all by the forward power. Of course, no actual directional coupler is ideal, so in practice the third port 103 actually outputs a coupled signal that includes both a desired coupled signal that is proportional to the forward power and an extraneous coupled signal that is proportional to the reverse power, and the fourth port 104 also outputs a coupled signal that includes both a desired coupled signal that is proportional to the reverse power and an extraneous coupled signal that is proportional to the forward power. The extraneous coupled signals negatively affect directivity.

Some conventional directional couplers attempt to limit extraneous coupled signals and improve directivity through manual tuning during production, which is time consuming and inflexible. For example, some conventional directional couplers include tuning blocks that are shifted to achieve desired directivity, and then glued in place. This process is time consuming in that the coupler lid must be removed repeatedly to adjust and readjust the tuning blocks, but replaced each time to measure directivity. Further, once the tuning blocks are set, the directional coupler is effectively limited to the frequency at which the tuning occurred. Similarly, some conventional directional couplers include metal tuning slugs that are threaded through the body of the directional coupler. Since the tuning slugs can be accessed from the outside, the coupler lid does not need to be removed for tuning. However, the manual alignment is still time consuming and cannot be easily readjusted for handling input signals having different frequencies.

Accordingly, there is a need to improve directivity of directional couplers, particularly by reducing or eliminating the effects of reverse power on the output of the third port 103, as well as by reducing or eliminating the effects of forward power on the output of the forth port 104. Generally, improving the directivity of a coupler enables more accurate measurements of the forward power and/or reverse power.

SUMMARY

In a representative embodiment, an adjustable directional coupler circuit includes a directional coupler and a correction circuit. The directional coupler includes a first port configured to receive an input signal from a signal source; a second port configured to output the input signal to a load; a third port configured to output a first coupled signal comprising a desired first coupled signal proportional to forward power of the input signal flowing from the first port to the second port and an extraneous first coupled signal proportional to reverse power of a reflected signal flowing from the second port to the first port, the reflected signal corresponding to a portion of the input signal reflected from the load; and a fourth port configured to output a second coupled signal comprising a desired second coupled signal proportional to the reverse power and an extraneous second coupled signal proportional to the forward power. The correction circuit is configured to adjust magnitude and phase of a sample of the second coupled signal to provide an adjusted second coupled signal, and to sum the adjusted second coupled signal and the first coupled signal to cancel the extraneous first coupled signal.

In another representative embodiment, a correction circuit is provided for a directional coupler comprising an input port configured to receive an input signal, an output port configured to output the input signal to a load, a forward coupled port configured to output a first coupled signal comprising a desired first coupled signal proportional to forward power of the input signal, and a reverse coupled port configured to output a second coupled signal comprising a desired second coupled signal proportional to reverse power of a reflected signal corresponding to a portion of the input signal reflected from the load. The correction circuit includes a first adjustable gain component configured to adjust a magnitude of the second coupled signal output from the reverse coupled port; a first adjustable phase shifter configured to adjust a phase of the second coupled signal to provide an adjusted second coupled signal; and a first summing circuit configured to add the adjusted second coupled signal and the first coupled signal at the forward coupled port in order to cancel an extraneous first coupled signal of the first coupled signal proportional to the reverse power of the reflected signal. The first adjustable gain component and the first adjustable phase shifter are adjustable based on a frequency of the input signal.

In another representative embodiment, a method is provided for cancelling directivity errors of a directional coupler comprising a first port configured to receive an input signal, a second port configured to output the input signal to a load, a third port configured to output a first coupled signal comprising a desired first coupled signal proportional to forward power of the input signal and an extraneous first coupled signal proportional to reverse power of a reflected signal corresponding to a portion of the input signal reflected from the load, and a fourth port configured to output a second coupled signal comprising a desired second coupled signal proportional to the reverse power and an extraneous second coupled signal proportional to the forward power. The method includes identifying a frequency of the input signal, retrieving gain and phase settings corresponding to the identified frequency, adjusting magnitude and phase of the second coupled signal according to the retrieved gain and phase settings, respectively, to provide an adjusted second coupled signal, combining the adjusted second coupled signal and the first coupled signal at the third port to cancel the extraneous first coupled signal, and outputting the desired first coupled signal.

BRIEF DESCRIPTION OF THE DRAWINGS

The illustrative embodiments are best understood from the following detailed description when read with the accompanying drawing figures. It is emphasized that the various features are not necessarily drawn to scale. In fact, the dimensions may be arbitrarily increased or decreased for clarity of discussion. Wherever applicable and practical, like reference numerals refer to like elements.

DETAILED DESCRIPTION

In the following detailed description, for purposes of explanation and not limitation, illustrative embodiments disclosing specific details are set forth in order to provide a thorough understanding of embodiments according to the present teachings. However, it will be apparent to one having had the benefit of the present disclosure that other embodiments according to the present teachings that depart from the specific details disclosed herein remain within the scope of the appended claims. Moreover, descriptions of well-known devices and methods may be omitted so as not to obscure the description of the example embodiments. Such methods and devices are within the scope of the present teachings. Generally, it is understood that the drawings and the various elements depicted therein are not drawn to scale.

According to various embodiments, an adjustable correction circuit is added to the forward and reverse coupled ports of a directional coupler to provide an additional stage of cancellation. Generally, the correction circuit samples the second coupled signal at the reverse coupled port, adjusts its magnitude and phase, and sums it with the first coupled signal output by the forward coupled port (which includes a desired first coupled signal as well as an extraneous first coupled signal). The magnitude and phase adjusted second coupled signal is substantially equal in magnitude and opposite in phase to the extraneous first coupled signal, which is therefore canceled out by a summing operation. In addition, the correction circuit samples the first coupled signal at the forward coupled port, adjusts its magnitude and phase, and sums it with the second coupled signal output by the reverse coupled port (which includes a desired second coupled signal as well as an extraneous second coupled signal). The magnitude and phase adjusted first coupled signal is substantially equal in magnitude and opposite in phase to the extraneous second coupled signal, which is therefore also canceled out by a summing operation.

Figure 1:
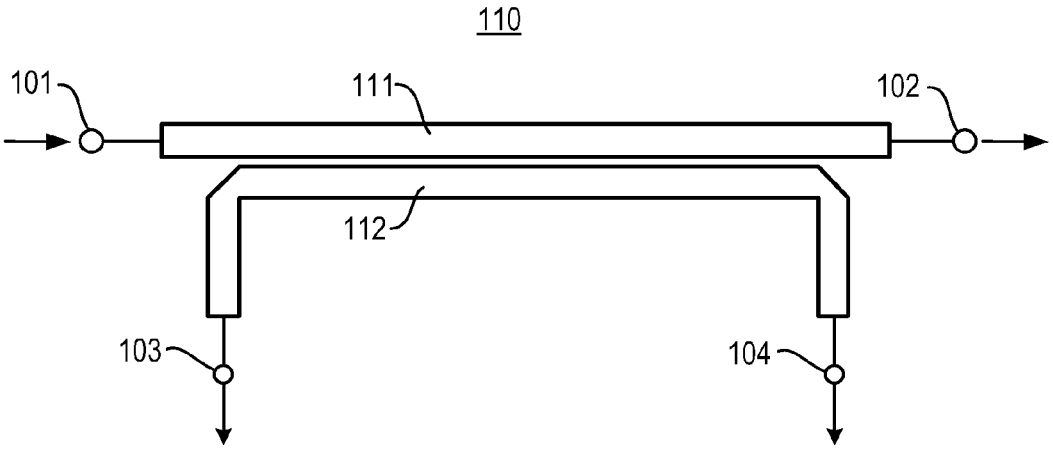
FIG. 1 is a simplified block diagram of a directional coupler.
Figure 2:
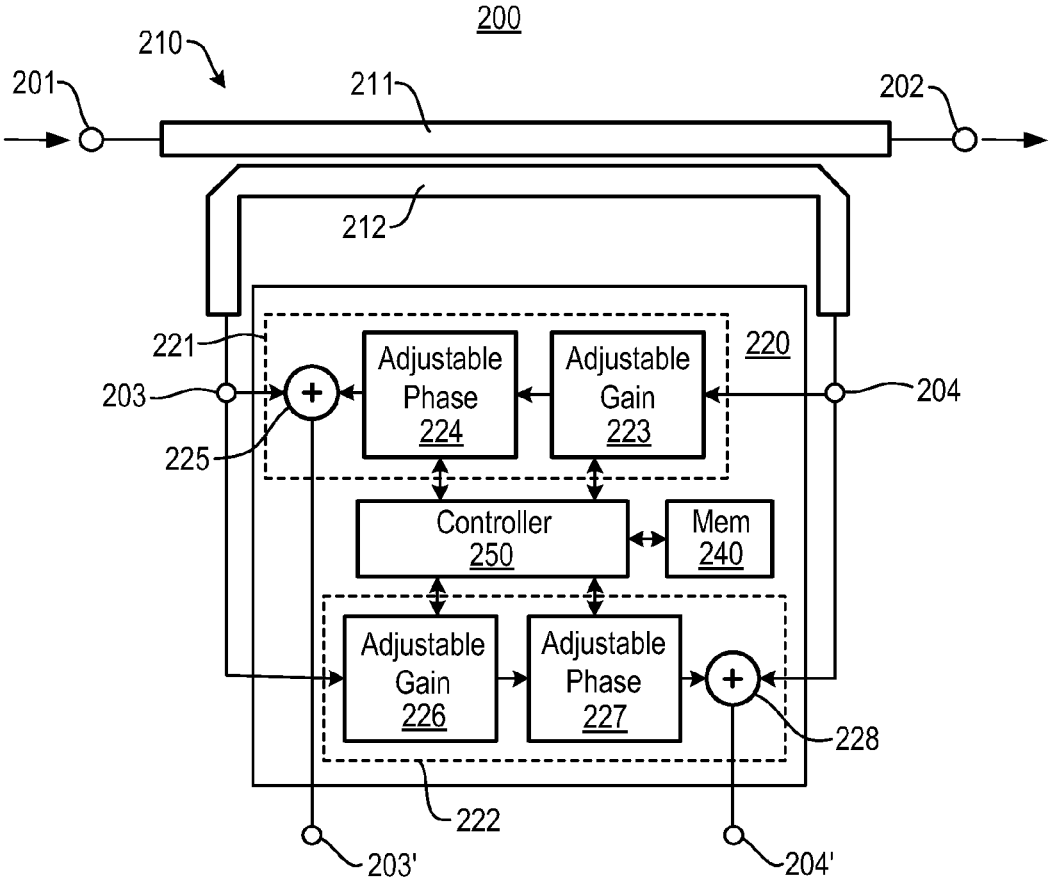
FIG. 2 is a simplified block diagram of an adjustable directional coupler circuit, according to a representative embodiment.

FIG. 2 is a simplified block diagram of an adjustable directional coupler circuit, according to a representative embodiment.

Referring to FIG. 2, adjustable directional coupler circuit 200 includes directional coupler 210 and correction circuit 220. As discussed above, the directional coupler 210 includes transmission line 211 having a first port 201 (input port) for receiving an input signal and a second port 102 (output port)

for outputting the input signal. The first port 201 may be connected to a signal source, such as a radio transmitter, to receive the input signal, and the second port 202 may be connected to a load, such as an antenna, for example. Of course the various embodiments are also applicable to various other types of signal sources and/or loads.

The directional coupler 210 also includes coupled line 212 having a third port 203 (forward coupled port) and a fourth port 204 (reverse coupled port). The third port 203 is configured to output a first coupled signal which includes a desired first coupled signal, having power proportional to the forward power of the input signal flowing from the first port 201 to the second port 202, and an extraneous first coupled signal, having power proportional to the reverse power of the reflected signal flowing from the second port 202 to the first port 201. The fourth port 204 is configured to output a second coupled signal which includes a desired second coupled signal, having power proportional to the reverse power of the reflected signal flowing from the second port 202 to the first port 201, and an extraneous second coupled signal, having power proportional to the forward power of the input signal flowing from the first port 201 to the second port 202. As mentioned above, the reflected signal corresponds to a portion of the input signal reflected from the load connected to the second port 202. Thus, by measuring the power of the desired first coupled signal and the desired second coupled signal at the third and fourth ports 203 and 204, respectively, the forward power and the reverse power may be determined.

The correction circuit 220 is configured to reduce or eliminate the extraneous first coupled signal output at the third port 203 and the extraneous second coupled signal output at the fourth port 204, thereby improving directivity of the directional coupler 210. The correction circuit 220 generally accomplishes this by substantially cancelling out the extraneous first coupled signal at the third port 203 using a sample of the second coupled signal output at the fourth port 204, and/or by substantially cancelling out the extraneous second coupled signal at the fourth port 203 using a sample of the first coupled signal output at the third port 203. Accordingly, the correction circuit 220 provides corrected third port 203' and/or corrected fourth port 204'. The corrected third port 203' outputs the desired first coupled signal with no or minimal extraneous first coupled signal. The corrected fourth port 204' outputs the desired second coupled signal with no or minimal extraneous second coupled signal.

In the depicted embodiment, the correction circuit 220 includes a first feed forward circuit 221 connected to the corrected third port 203', a second feed forward circuit 222 connected to the corrected fourth port 204', a memory 240, and a controller 250. Notably, in alternative embodiments, the correction circuit 220 may include only one of the first and second feed forward circuits 221 and 222 for reducing or eliminating the corresponding one of the extraneous first and second coupled signals, respectively, without departing from the scope of the present teachings.

The first feed forward circuit 221 is configured to adjust magnitude (amplitude) and phase of a sample of the second coupled signal at the fourth port 204 to provide an adjusted second coupled signal, and to add the adjusted second coupled signal and the first coupled signal at the third port 203 to cancel out all or a portion of the extraneous first coupled signal, leaving the desired first coupled signal. The first feed forward circuit 221 includes first adjustable gain component 223, first adjustable phase shifter 224 and first summing circuit 225. The first adjustable gain component 223 is configured to adjust the magnitude of the sample of the second coupled signal received from the fourth port 204 to match the magnitude of the extraneous first coupled signal. The first adjustable gain component 223 may be implemented using a programmable attenuator or variable resistor, for example. The first adjustable phase shifter 224 is configured to adjust the phase of the sample of the second coupled signal received from the first adjustable gain component 223, e.g., to be in phase or 180 degrees out of phase with the phase of the extraneous first coupled signal (depending on the type of first summing circuit 225), to provide an adjusted second coupled signal. The first adjustable phase shifter 224 may be implemented using selectable delay lines having different lengths, for example. Of course the order of the first adjustable gain component 223 and the first adjustable phase shifter 224 may be reversed, without departing from the scope of the present teachings.

The adjusted second coupled signal is input to the first summing circuit 225, which combines the adjusted second coupled signal with the first coupled signal at the third port 203, substantially canceling the extraneous first coupled signal. Thus, the desired first coupled signal alone is output at the corrected third port 203'. The first summing circuit 225 may be implemented using a transformer, a resistive combiner or a differential amplifier, for example. The resistive combiner may be a three-resistor combiner that includes a first resistor connected to the first adjustable phase shifter 224 to receive the adjusted second coupled signal, a second resistor connected to the third port 203 to receive the combined first coupled signal and extraneous first coupled signal, and a third resistor connected to the corrected third port 203' to output the first coupled signal. Each of the first through third resistors may have the same value, for example. Use of a three-resistor combiner would require the second coupled signal to be shifted to 180 degrees out of phase with the extraneous first coupled signal to provide the adjusted second coupled signal. The differential amplifier may include differential input ports connected to the first adjustable phase shifter 224 and the third port 203, respectively, and an output port connected to the corrected third port 203' and configured to output a difference between the adjusted second coupled signal and the first coupled signal, thus providing the desired first coupled signal. Notably, use of a differential amplifier would require the second coupled signal to be shifted to 0 degrees out of phase (or, in phase) with the extraneous first coupled signal to provide the adjusted second coupled signal. Of course, other types of summing circuits may be included without departing from the scope of the present teachings.

The magnitude and phase of the extraneous first coupled signal vary according to frequency of the input signal. For example, the correct adjustment amounts of the first adjustable gain component 223 and the first adjustable phase shifter 224 for an input signal at 200 MHz is different than the correct adjustment amounts for an input signal at 1 GHz. Therefore, the amount of gain adjusted by the first adjustable gain component 223 and the amount of phase shifted by the first adjustable phase shifter 224 are set as a function of the frequency of the input signal.

In order to determine the appropriate amounts of gain and phase shifting, the correction circuit 220 is previously calibrated for multiple different input signal frequencies. The gain and phase settings corresponding to each input signal frequency are stored in memory 240, along with the corresponding input signal frequency, during the calibration phase of the correction circuit 220. The input signal frequencies for which calibration is performed may be discretionary. For example, a user may wish to cover a broad range of input signal frequencies, and therefore provide gain and phase settings corresponding to input signal frequencies from 25 MHz to 4 GHz at 25 MHz intervals. Of course, other frequency ranges and increments may be included without departing from the scope of the present teachings.

In order to calibrate the gain and phase settings, input signals having the desired frequencies are consecutively applied to the directional coupler circuit 200 (or to a direction coupling circuit having the same characteristics). For each input signal frequency, the first adjustable gain component 223 and the first adjustable phase shifter 224 are adjusted until the extraneous first coupled signal is no longer detected at the output of the third port 203. The respective gain and phase settings are then stored in the memory 240 in relation to the input signal frequency.

Once the calibrated gain and phase settings and corresponding input signal frequencies are stored in memory 240, they may be selectively retrieved by the controller 250 and applied to the first adjustable gain component 223 and the first adjustable phase shifter 224 in accordance with the frequency of the input signal. In an embodiment, the frequency of the input signal may be determined manually. For example, the user may set the numeric value of the input signal frequency in the controller 250 using an interface, such as a rotatable knob, a key pad, a touch screen, or the like. In alternative embodiments, the frequency of the input signal may be determined automatically by automated test equipment and/or single detectors, such as a radio receiver, an oscilloscope, a signal analyzer, or the like. Regardless of how the input signal frequency is identified, the controller 250 retrieves the previously stored gain and phase settings corresponding to the input signal frequency from the memory 240 from among multiple previously stored gain and phase settings, and applies the retrieved gain and phase settings to the first adjustable gain component 223 and the first adjustable phase shifter 224, respectively.

The controller 250 may be implemented, at least in part, using one or more processing devices, such as a processor, a microprocessor, one or more application specific integrated circuits (ASICs), one or more field-programmable gate arrays (FPGAs), or combinations thereof, using software, firmware, hard-wired logic circuits, or combinations thereof. The controller 250 includes an interface for interfacing with the means by which the input signal frequency is identified, discussed above. The memory 240 may include non-transitory, tangible computer readable medium for storing the calibrated gain and phase settings and corresponding frequencies, such as read only memory (ROM), electrically programmable ROM (EPROM), erasable EPROM (EEPROM), flash memory, random access memory (RAM) static RAM (SRAM), dynamic RAM (DRAM), a USB drive, and the like. The memory 240 may be a relational database, for example.

The second feed forward circuit 222 is configured to adjust magnitude and phase of a sample of the first coupled signal at the third port 203 to provide an adjusted first coupled signal, and to add the adjusted first coupled signal and the second coupled signal at the fourth port 204 to cancel out all or a portion of the extraneous second coupled signal, leaving the desired second coupled signal. The second feed forward circuit 222 is implemented in substantially the same manner as the first feed forward circuit 221, discussed above, except in the opposite direction. That is, the second forward circuit 221 includes second adjustable gain component 226, second adjustable phase shifter 227 and second summing circuit 228. The second adjustable gain component 226 is configured to adjust the magnitude of the sample of the first coupled signal received from the third port 203 to match the magnitude of the extraneous second coupled signal. The second adjustable phase shifter 227 is configured to adjust the phase of the sample of the first coupled signal received from the second adjustable gain component 226, e.g., to be in phase or 180 degrees out of phase with the phase of the extraneous second coupled signal (depending on the type of second summing circuit 228), to provide an adjusted first coupled signal. Of course the order of the second adjustable gain component 226 and the second adjustable phase shifter 227 may be reversed, without departing from the scope of the present teachings. The adjusted first coupled signal is input to the second summing circuit 228, which combines the adjusted first coupled signal with the second coupled signal at the fourth port 204, substantially canceling the extraneous second coupled signal. Thus, the desired second coupled signal alone is output at the corrected fourth port 204'.

The magnitude and phase of the extraneous second coupled signal vary according to frequency of the input signal. Therefore, the amount of gain adjusted by the second adjustable gain component 226 and the amount of phase shifted by the second adjustable phase shifter 227 are set as a function of the frequency of the input signal. In order to determine the appropriate amounts of gain and phase shifting, the correction circuit 220 may be previously calibrated for multiple different input signal frequencies. The gain and phase settings of the second adjustable gain component 226 and the second adjustable phase shifter 227 corresponding to each desired input signal frequency are stored in memory 240, along with the corresponding input signal frequency, during the calibration phase of the correction circuit 220, as discussed above.

Figure 3:
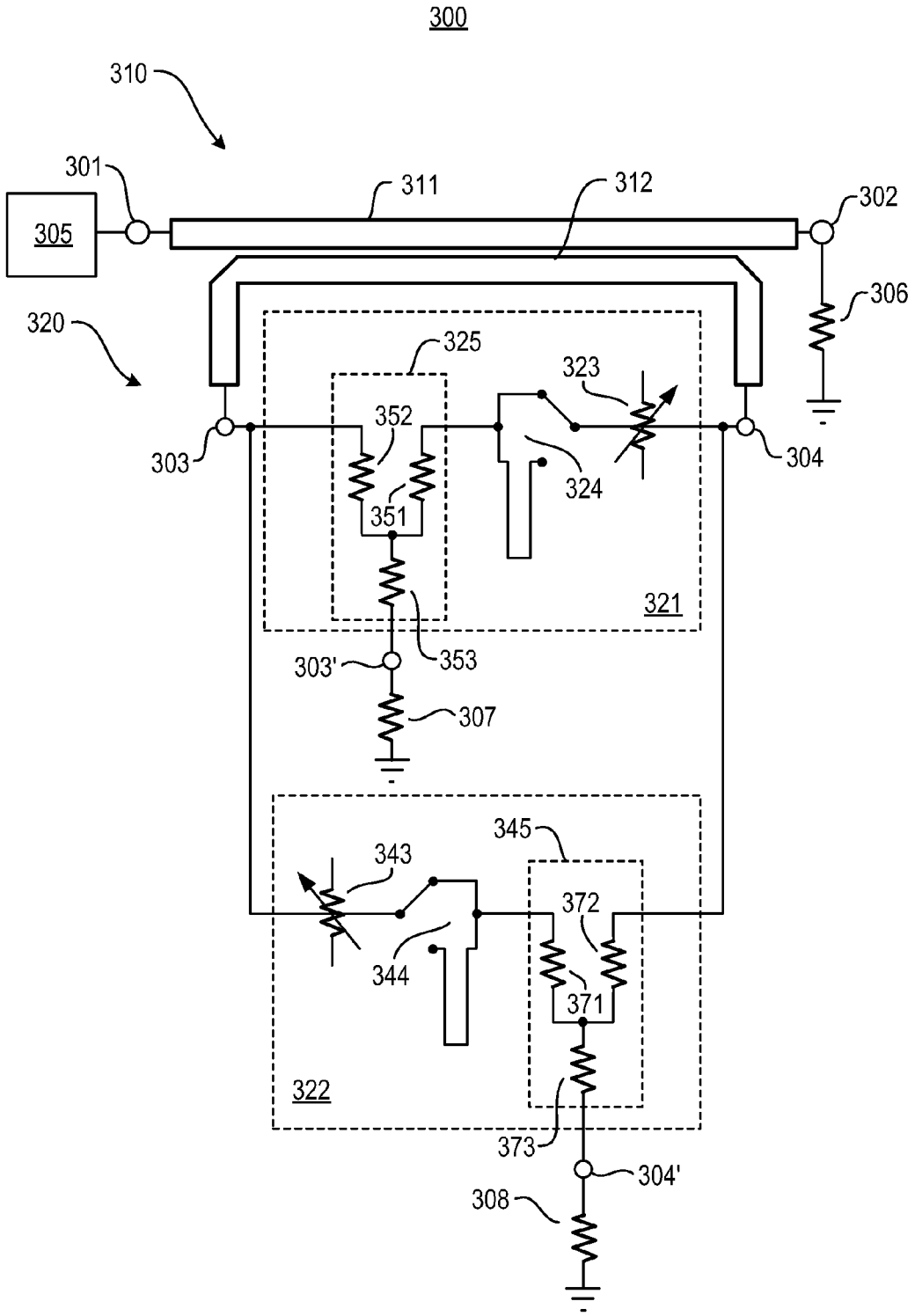
FIG. 3 is a simplified circuit diagram of the adjustable directional coupler circuit of FIG. 2, according to a representative embodiment.

FIG. 3 is a simplified circuit diagram of an adjustable directional coupler circuit of FIG. 2, according to a representative embodiment. More particularly, FIG. 3 shows only an embodiment of a first feed forward circuit connected between the fourth port and the third port and a second feed forward circuit connected between the third port and the fourth port, which may be implemented in substantially the same manner, except in the opposite direction, as mentioned above.

Referring to FIG. 3, adjustable directional coupler circuit 300 includes directional coupler 310 and correction circuit 320, which are illustrative implementations of the directional coupler 210 and the correction circuit 220, discussed above. The directional coupler 310 includes transmission line 311 having a first port 301 (input port) for receiving an input signal from signal source 305 (e.g., transmitter) and a second port 302 (output port) for outputting the input signal to load 306 (e.g., antenna). For purposes of illustration, it may be assumed that the input signal has a frequency of about 1 GHz.

The directional coupler 310 also includes coupled line 312 having a third port 303 (forward coupled port) and a fourth port 304 (reverse coupled port). The third port 303 is configured to output a first coupled signal, which includes a desired first coupled signal having power proportional to the forward power of the input signal and an extraneous first coupled signal having power proportional to the reverse power of the reflected signal. The fourth port 304 is configured to output a second coupled signal, which includes a desired second coupled signal having power proportional to the reverse power of the reflected signal and an extraneous second coupled signal having power proportional to the forward power of the input signal.

The correction circuit 320 is configured to reduce or eliminate the extraneous first coupled signal output at the third port 303 and the extraneous second coupled signal output at the fourth port 304, thereby improving directivity of the directional coupler 310. In particular, first feed forward circuit 321 is configured to substantially cancel out the extraneous first coupled signal at the third port 303 using a sample of the second coupled signal output at the fourth port 304, and second feed forward circuit 322 is configured to substantially cancel out the extraneous second coupled signal at the fourth port 304 using a sample of the first coupled signal output at the third port 303.

In the depicted embodiment, the first feed forward circuit 321 is connected to the third port 303, the fourth port 304 and corrected third port 303', as well as to the memory 240 and the controller 250 (not shown in FIG. 3), which enable adjusting magnitude and phase of a sample of the second coupled signal at the fourth port 304 to provide an adjusted second coupled signal, discussed below. The first feed forward circuit 321 includes programmable attenuator 323, delay line selector 324 and three-resistor combiner 325. The three-resistor combiner 325 includes input resistor 351 connected to the delay line selector 324, input resistor 352 connected to the third port 303, and output resistor 353 connected to the corrected third port 303'. The value of each of the input resistor 351, the input resistor 352 and the output resistor 353 may be about 16.7 ohms, for example.

The programmable attenuator 323 is configured to adjust the magnitude of a sample of the second coupled signal received from the fourth port 304 to match the magnitude of the extraneous first coupled signal at the third port 303. The level of attenuation (or resistance) of the programmable attenuator 323 may be set by the controller 250, which retrieves the setting corresponding to the 1 GHz input signal frequency from the memory 240. The delay line selector 324 is configured to adjust the phase of the sample of the second coupled signal received from the programmable attenuator 323 to be 180 degrees out of phase with the phase of the extraneous first coupled signal to provide an adjusted second coupled signal. The phase is adjusted by selecting the one of multiple delay lines having different lengths that corresponds to the 1 GHz input signal frequency. In the depicted embodiment, the delay line selector 324 includes two representative delay lines, one of which corresponds to the 1 GHz input signal frequency and the other of which corresponds to a 200 MHz inputs signal frequency. Of course, the delay line selector 324 may include alternative and/or additional delay lines corresponding to different input signal frequencies, without departing from the scope of the present teachings. The selection is made by the controller 250, which retrieves the delay line setting corresponding to the 1 GHz input signal frequency from the memory 240. Also, as mentioned above, the order of the programmable attenuator 323 and the delay line selector 324 may be reversed, without departing from the scope of the present teachings.

The adjusted second coupled signal output by the delay line selector 324 is provided to one input of the three-resistor combiner 325 (at the input resistor 351), and the first coupled signal output by the third port 303 (including the desired first coupled signal and the extraneous first coupled signal) is provided to the other input of the three-resistor combiner 325 (at the input resistor 352). As a result, the three-resistor combiner 325 substantially cancels the extraneous first coupled signal by combining the input signals, and outputs (at the output resistor 353) only the desired first coupled signal to the corrected third port 303'. Impedance of the corrected third port 303' is represented by resistor 307, which may be about 50 ohms, for example.

Also in the depicted embodiment, the second feed forward circuit 322 is connected to the fourth port 304, the third port 303 and corrected fourth port 304', as well as to the memory 240 and the controller 250 (not shown in FIG. 3), which enable adjusting magnitude and phase of a sample of the first coupled signal at the third port 303 to provide an adjusted first coupled signal, discussed below. Similar to the first feed forward circuit 321, the second feed forward circuit 322 includes programmable attenuator 343, delay line selector 344 and three-resistor combiner 345. The three-resistor combiner 345 includes input resistor 371 connected to the delay line selector 344, input resistor 372 connected to the fourth port 304, and output resistor 373 connected to the corrected fourth port 304'. The value of each of the input resistor 371, the input resistor 372 and the output resistor 373 may be about 16.7 ohms, for example.

The programmable attenuator 343 is configured to adjust the magnitude of a sample of the first coupled signal received from the third port 303 to match the magnitude of the extraneous second coupled signal at the forth port 304. The level of attenuation (or resistance) of the programmable attenuator 343 may be set by the controller 250, as discussed above. The delay line selector 344 is configured to adjust the phase of the sample of the first coupled signal received from the programmable attenuator 343 to be 180 degrees out of phase with the phase of the extraneous second coupled signal to provide an adjusted first coupled signal. The phase is adjusted under control of the controller 250 as discussed above. The order of the programmable attenuator 343 and the delay line selector 344 may be reversed, without departing from the scope of the present teachings.

The adjusted first coupled signal output by the delay line selector 344 is provided to one input of the three-resistor combiner 345 (at the input resistor 371), and the second coupled signal output by the fourth port 304 (including the desired second coupled signal and the extraneous second coupled signal) is provided to the other input of the three-resistor combiner 345 (at the input resistor 372). As a result, the three-resistor combiner 345 substantially cancels the extraneous second coupled signal by combining the input signals, and outputs (at the output resistor 373) only the desired second coupled signal to the corrected fourth port 304'. Impedance of the corrected third port 304' is represented by resistor 308, which may be about 50 ohms, for example.

Figure 4:
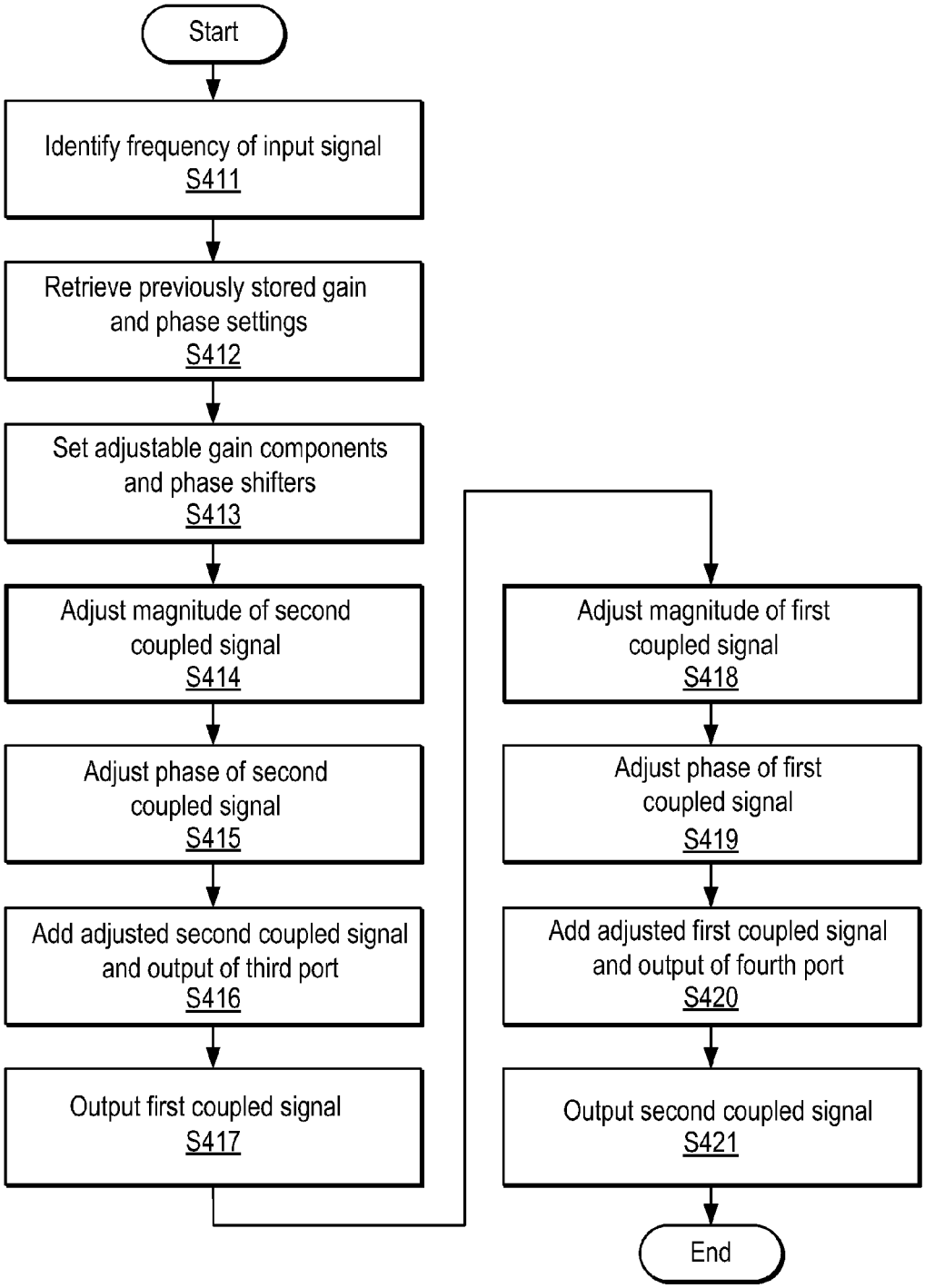
FIG. 4 is a flow diagram showing a method of cancelling directivity errors of a directional coupler, according to a representative embodiment.

FIG. 4 is a flow diagram showing a method of canceling directivity errors of a directional coupler, according to a representative embodiment.

As discussed above, the directional coupler includes a first port (input port) configured to receive an input signal, a second port (transmit port) configured to output the input signal to a load, a third port (forward coupled port) configured to output a first coupled signal including a desired first coupled signal proportional to forward power of the input signal and an extraneous first coupled signal proportional to reverse power of a reflected signal corresponding to a portion of the input signal reflected from the load, and a fourth port (reverse coupled port) configured to output a second coupled signal including a desired second coupled signal proportional to the reverse power an extraneous second coupled signal proportional to the forward power. The method of canceling directivity errors of the directional coupler substantially cancels out the extraneous first coupled signal from the output of the third port and the extraneous second coupled signal from output of the fourth port using a correction circuit (e.g., correction circuit 220).

Referring to FIG. 4, frequency of the input signal is identified in block S411. For example, the frequency of the input signal may be provided to the controller 250 by a user via an interface, such as a rotatable knob, a key pad, a touch screen, or the like, or the frequency may be determined and provided by automated test equipment and/or single detector. In block S412, previously stored gain and phase settings corresponding to the input signal frequency identified in block S411 are retrieved from memory. For example, the controller 250 may retrieve the previously stored gain and phase settings from the memory 240 using a look-up table or other retrieval tool. The gain and phase settings are determined during an initial calibration process, during which the gain and phase settings may be empirically determined, for example, by applying input signals having various predetermined frequencies to the directional coupler and adjusting the gain and phase settings until the extraneous first and second coupled signals are canceled from the outputs of the third and fourth ports, respectively. The determined gain and phase settings may then be stored in the memory 240 for future use. In block S413, the retrieved gain and phase settings are used to set adjustable gain components (e.g., first and second adjustable gain components 223, 226) and adjustable phase shifters (e.g., first and second adjustable phase shifters 224, 227).

Notably, blocks S414 to S417 in FIG. 4 are directed to canceling the extraneous first coupled signal from the output of the third port 203, leaving the desired first coupled signal. Similarly, blocks S418 to S421 are directed to canceling the extraneous second coupled signal from the output of the fourth port 203, leaving the desired second coupled signal. The order of steps shown in FIG. 4 is not intended to be limiting. Rather, all or part of blocks S414 to S417 may be performed before or after all or part of blocks S418 to S421 are performed, or all or a portion of blocks S414 to S417 blocks may be performed at substantially the same time as all or a portion of blocks S418 to S421, without departing from the scope of the present teachings. Also, in alternative embodiments, the correction circuit may be configured to cancel only one of the extraneous first coupled signal or the extraneous second coupled signal, in which case only blocks S414 to S417 or blocks S418 to S421 would be performed. Cancelation of both is discussed herein for purposes of illustration.

In block S414, the magnitude of a sample of the second coupled signal from the fourth port is adjusted by the set first adjustable gain component 223 to match the magnitude of the extraneous first coupled signal. In block S415, the phase of the sample of the second coupled signal is adjusted by the set first adjustable phase shifter 224 to provide an adjusted second coupled signal that has a desired phase relationship (e.g., in phase or 180 degrees out of phase) with the extraneous first coupled signal. In block S416, the adjusted second coupled signal is added to the first coupled signal at the third port 203, such that the adjusted second coupled signal substantially cancels the extraneous first coupled signal in the first coupled signal, leaving the desired first coupled signal, which is output in block S417.

Similarly, the magnitude of a sample of the first coupled signal from the third port is adjusted by the set adjustable gain component 226 in block S418 to match the magnitude of the extraneous second coupled signal. In block S419, the phase of the sample of the first coupled signal is adjusted by the set adjustable phase shifter 227 to provide an adjusted first coupled signal that has a desired phase relationship (e.g., in phase or 180 degrees out of phase) with the extraneous second coupled signal. In block S420, the adjusted first coupled signal is added to the output of the fourth port 204, such that the adjusted first coupled signal substantially cancels the extraneous second coupled signal in the second coupled signal, leaving the desired second coupled signal, which is output in block S421.

All or a portion of the various operations discussed above with reference to FIG. 4 may be included in logic executable by a computer processor or other processing device, such as the controller 250, discussed above, and/or some combination of processing devices (e.g., by distributed processing). The operations may be implemented using internal logic or software, stored on a computer readable medium, examples of which are discussed above, and executable by one or more computer processors, ASICs, FPGAs or combinations thereof.

Figure 5A:
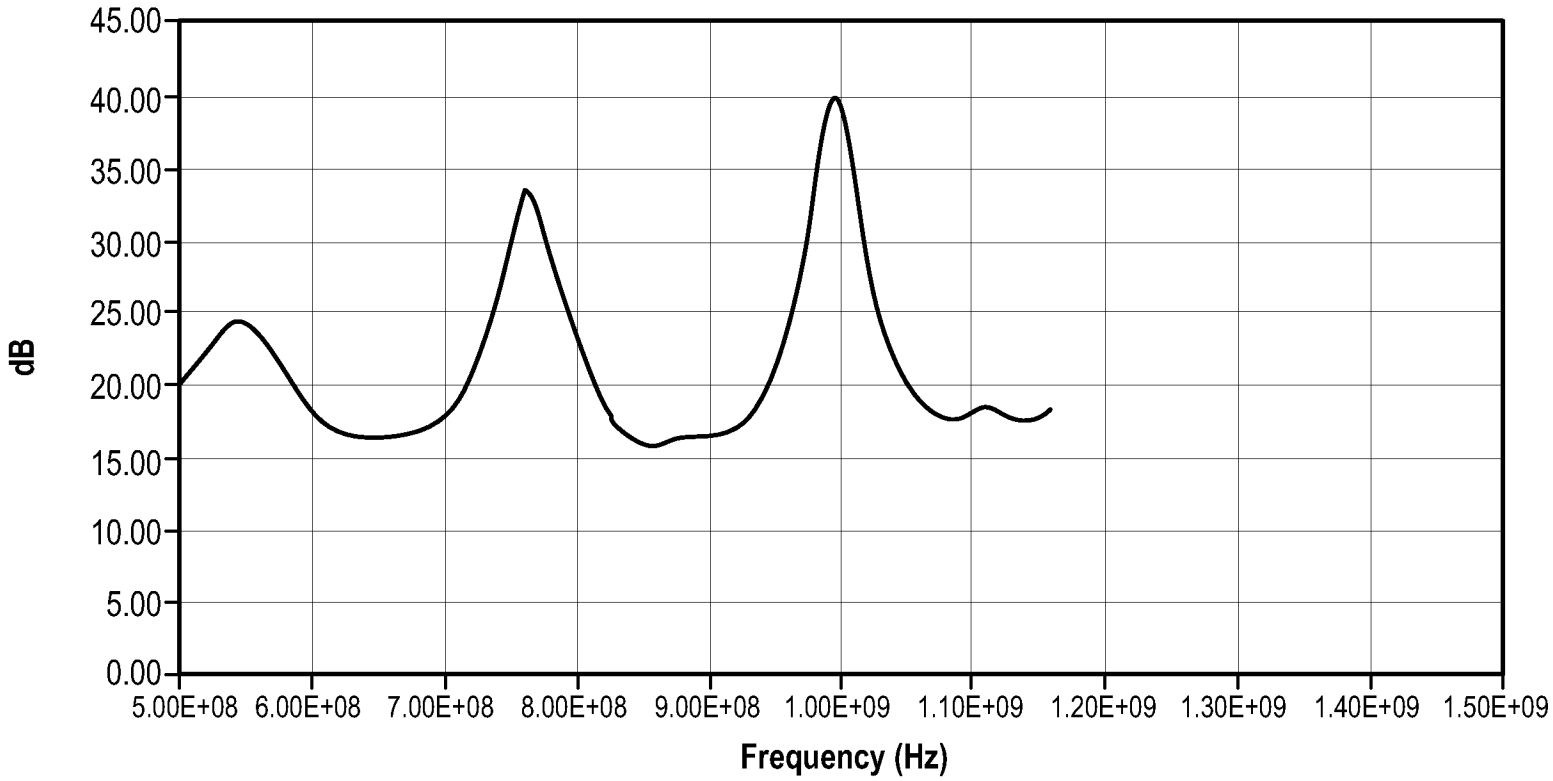
FIG. 5A is a graph depicting directivity of the adjustable directional coupler circuit of FIG. 2, calibrated for performance at 1 GHz, according to a representative embodiment.
Figure 5B:
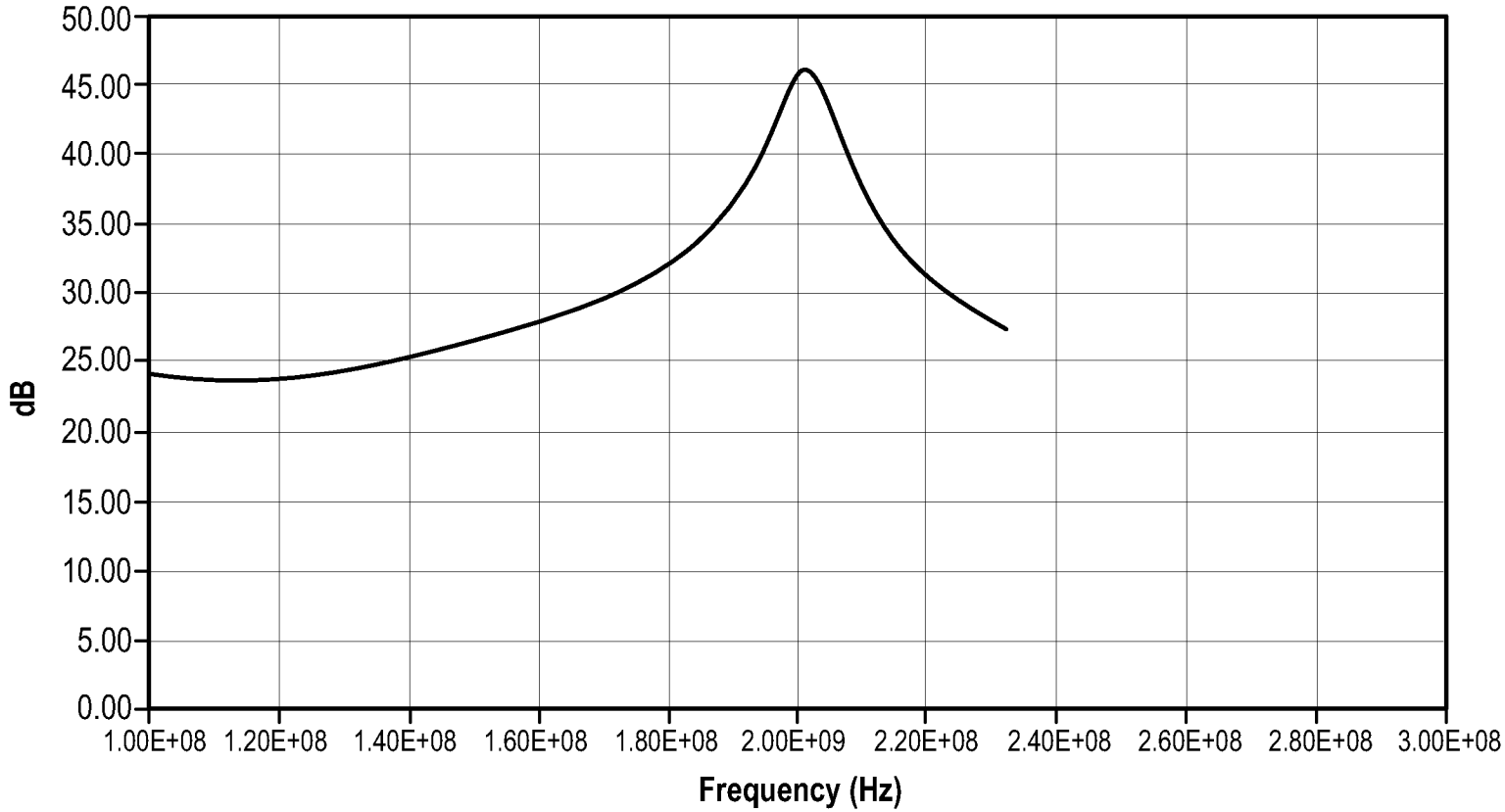
FIG. 5B is a graph depicting directivity of the adjustable directional coupler circuit of FIG. 2, calibrated for performance at 200 MHz, according to a representative embodiment.

FIG. 5A is a graph depicting directivity versus frequency of the adjustable directional coupler circuit of FIG. 2 tuned to 1 GHz, according to a representative embodiment. As shown, the directional coupler circuit 200 achieves a directivity of about 40 dB at 1 GHz. In this case, the directional coupler 210 would be considered a high frequency directional coupler. FIG. 5B is a graph depicting directivity versus frequency of the adjustable directional coupler circuit of FIG. 2 tuned to 200 MHz, according to a representative embodiment. As shown, the directional coupler circuit 200 achieves a directivity of about 46 dB at 200 MHz. In this case, the directional coupler 210 would be considered a low frequency directional coupler. The directional coupler 210 thus exhibits good directivity (e.g., better than −30 dB and even better than −40 dB) over a broad frequency range (e.g., 200 MHz to 1 GHz).

Figure 6A:
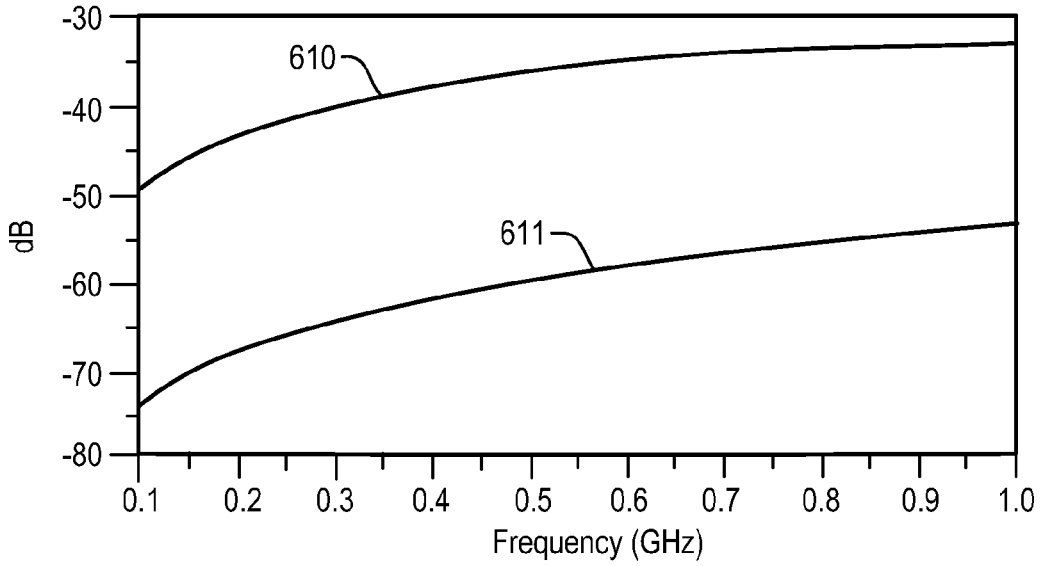
FIG. 6A is a graph depicting S-parameters $S_{31}$ and $S_{32}$ indicating directivity of a conventional directional coupler.
Figure 6B:
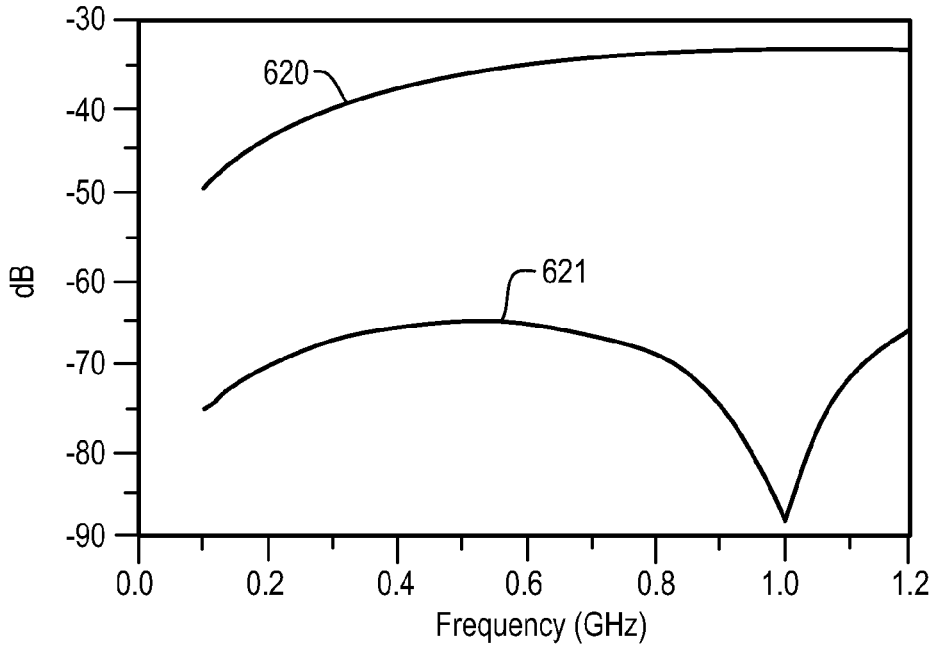
FIG. 6B is a graph depicting S-parameters $S_{31}$ and $S_{32}$ indicating directivity of the adjustable directional coupler circuit of FIG. 2, according to a representative embodiment.

FIG. 6A is a graph depicting S-parameters $S_{31}$ and $S_{32}$ indicating directivity of a conventional directional coupler, for purposes of comparison. FIG. 6B is a graph depicting S-parameters $S_{31}$ and $S_{32}$ indicating directivity of the adjustable directional coupler circuit of FIG. 2, according to a representative embodiment.

Directivity is effectively the difference between $S_{32}$ and $S_{31}$. Referring to FIG. 6A, curve 610 shows S-parameter $S_{31}$ and curve 611 shows S-parameter $S_{32}$. At an input signal frequency of 1 GHz, $S_{31}$ is measured at approximately −33 dB and $S_{32}$ is measured at approximately −53 dB. Therefore, the conventional directional coupler tuned for 1 GHz has directivity of about 20 dB. In comparison, referring to FIG. 6B, curve 620 shows S-parameter $S_{31}$ and curve 621 shows S-parameter $S_{32}$. At an input signal frequency of 1 GHz, $S_{31}$ is measured at approximately −33 dB and $S_{32}$ is measured at approximately −88 dB. Therefore, the directional coupler circuit tuned for 1 GHz according to a representative embodiment has directivity of about 55 dB.

According to various embodiments, an adjustable correction circuit can be added to any directional coupler to improve its directivity. The adjustable correction circuit eliminates extraneous first and second coupled signals from the forward and reverse coupled ports, respectively, and enables easy adjustments to components for flexible application over a broad range of input signal frequencies. This enables better directivity over a broad range of input signal frequencies than could be achieved by simply by attempting to manually tune a conventional coupler. For example, conventional couplers generally have less than 25 dB of directivity between 25 MHz and 1000 MHz. The various embodiments discussed herein are able to achieve 40 dB of directivity or more over this same range. In addition, because the adjustable correction circuit may be connected to outputs of any directional coupler (e.g., forward and reverse coupled ports), excellent directivity may be achieved even if the directional coupler otherwise has mediocre directivity. Also, since the adjustable correction circuit is computer/processing circuit controlled (e.g., by controller 250), alignment may be accomplished automatically with a computer and automated test equipment.

While the disclosure references exemplary embodiments, it will be apparent to those skilled in the art that various changes and modifications may be made without departing from the spirit and scope of the present teachings. Therefore, it should be understood that the above embodiments are not limiting, but illustrative.

What is claimed:

1. An adjustable directional coupler circuit, comprising:

a directional coupler comprising:

a first port configured to receive an input signal from a signal source;

a second port configured to output the input signal to a load;

a third port configured to output a first coupled signal comprising a desired first coupled signal proportional to forward power of the input signal flowing from the first port to the second port and an extraneous first coupled signal proportional to reverse power of a reflected signal flowing from the second port to the first port, the reflected signal corresponding to a portion of the input signal reflected from the load; and a fourth port configured to output a second coupled signal comprising, a desired second coupled signal proportional to the reverse power and an extraneous second coupled signal proportional to the forward power; and a correction circuit comprising an adjustable gain component configured to adjust a magnitude of a sample of the second coupled signal, and an adjustable phase shifter configured to adjust a phase of the sample of the second coupled signal, the correction circuit being configured to adjust the magnitude and phase of the sample of the second coupled signal to provide an adjusted second coupled signal, and to sum the adjusted second coupled signal and the first coupled signal at the third port to cancel the extraneous first coupled signal.

2. The adjustable directional coupler circuit of claim 1, wherein the correction circuit is further configured to adjust magnitude and phase of a sample of the first coupled signal to provide an adjusted first coupled signal, and to sum the adjusted first coupled signal and the second coupled signal at the fourth port to cancel out the extraneous second coupled signal.

3. The adjustable directional coupler circuit of claim 1, wherein the signal source comprises a radio transmitter, and the load comprises an antenna.

4. The adjustable directional coupler circuit of claim 1, wherein the magnitude and the phase are adjusted as a function of frequency of the input signal.

5. The adjustable directional coupler circuit of claim 4, wherein adjustment amounts for adjusting the magnitude and the phase, respectively, are previously set for each of a plurality of frequencies of the input signal by calibrating the settings at the plurality of frequencies.

6. The adjustable directional coupler circuit of claim 5, further comprising:

a memory for storing the adjustment amounts corresponding to the calibrated settings; and a controller configured to retrieve the adjustment amounts from the memory based on the frequency of the input signal and to control the adjustment of the magnitude and the phase according to the adjustment amounts.

7. A correction circuit for a directional coupler comprising an input port configured to receive an input signal, an output port configured to output the input signal to a load, a forward coupled port configured to output a first coupled signal comprising a desired first coupled signal proportional to forward power of the input signal and an extraneous first coupled signal proportional to reverse power of a reflected signal corresponding to a portion of the input signal reflected from the load, and a reverse coupled port configured to output a second coupled signal comprising a desired second coupled signal proportional to the reverse power of the reflected signal, the correction circuit comprising:

a first adjustable gain component configured to adjust a magnitude of the second coupled signal output from the reverse coupled port;

a first adjustable phase shifter configured to adjust a phase of the second coupled signal to provide an adjusted second coupled signal; and a first summing circuit configured to add the adjusted second coupled signal and the first coupled signal at the forward coupled port in order to cancel the extraneous first coupled signal, wherein the first adjustable gain component and the first adjustable phase shifter are adjustable in response to a frequency of the input signal.

8. The correction circuit of claim 7, further comprising:

a second adjustable gain component configured to adjust a magnitude of the first coupled signal output from the forward coupled port;

a second adjustable phase shifter configured to adjust a phase of the first coupled signal to provide an adjusted first coupled signal; and a second summing circuit configured to add the adjusted first coupled signal and the second coupled signal at the reverse coupled port, the second coupled signal further comprising an extraneous second coupled signal proportional to the forward power of the input signal, in order to cancel the extraneous second coupled signal.

9. The correction circuit of claim 7, wherein the first adjustable gain component comprises a programmable attenuator.

10. The correction circuit of claim 7, wherein the first summing circuit comprises a resistive combiner.

11. The correction circuit of claim 7, wherein the first summing circuit comprises a differential amplifier configured to output a difference between the adjusted second coupled signal and the first coupled signal.

12. The correction circuit of claim 7, wherein the first summing circuit comprises a transformer.

13. The correction circuit of claim 7, wherein the first adjustable phase shifter is configured to adjust the phase of the second coupled signal so that the second coupled signal is 180 degrees out of phase with the extraneous first coupled signal at the forward coupled port.

14. The correction circuit of claim 13, wherein the first adjustable gain component is configured to adjust the magnitude of the second coupled signal so that the adjusted second coupled signal has a magnitude that is substantially the same as a magnitude of the extraneous first coupled signal at the forward coupled port.

15. An adjustable directional coupler, comprising:

a first port configured to receive an input signal from a signal source;

a second port configured to output the input signal to a load;

a third port configured to output a first coupled signal comprising a desired first coupled signal proportional to forward power of the input signal flowing from the first port to the second port and an extraneous first coupled signal proportional to reverse power of a reflected signal flowing from the second port to the first port, the reflected signal corresponding to a portion of the input signal reflected from the load; and a fourth port configured to output a second coupled signal comprising a desired second coupled signal proportional to the reverse power and an extraneous second coupled signal proportional to the forward power; and a correction circuit configured to adjust magnitude and phase of a sample of the second coupled signal to provide an adjusted second coupled signal, and to sum the adjusted second coupled signal and the first coupled signal at the third port to cancel the extraneous first coupled signal, wherein the magnitude and the phase are adjusted as a function of frequency of the input signal, and adjustment amounts for adjusting the magnitude and the phase, respectively, are previously set for each of a plurality of frequencies of the input signal by calibrating the settings at the plurality of frequencies.

16. The adjustable directional coupler circuit of claim 15, further comprising:

a memory for storing the adjustment amounts corresponding to the calibrated settings; and a controller configured to retrieve the adjustment amounts from the memory based on the frequency of the input signal and to control the adjustment of the magnitude and the phase according to the adjustment amounts.

17. The adjustable directional coupler circuit of claim 15, wherein the signal source comprises a radio transmitter, and the load comprises an antenna.

18. The adjustable directional coupler circuit of claim 15, wherein the correction circuit is further configured to adjust magnitude and phase of a sample of the first coupled signal to provide an adjusted first coupled signal, and to sum the adjusted first coupled signal and the second coupled signal at the fourth port to cancel out the extraneous second coupled signal.

* * * * *